US005397666A

United States Patent [19]

Fukuda et al.

[11] Patent Number: 5,397,666

[45] Date of Patent: Mar. 14, 1995

[54] ELECTROPHOTOGRAPHIC PHOTORECEPTOR AND PROCESS FOR PRODUCING THE SAME

[75] Inventors: Yuzuru Fukuda; Shigeru Yagi, both of Kanagawa; Ken Ebihara, Shizuoka; Yasunobu Iwata, Tokyo, all of Japan

[73] Assignee: Fuji Xerox Co., Ltd., Tokyo, Japan

[21] Appl. No.: 182,367

[22] Filed: Jan. 18, 1994

Related U.S. Application Data

[63] Continuation of Ser. No. 943,111, Sep. 10, 1992, abandoned, which is a continuation of Ser. No. 586,285, Sep. 21, 1990, abandoned.

[30] Foreign Application Priority Data

Sep. 25, 1989 [JP] Japan ..... 1-246503

[51] Int. Cl.[6] ..... G03G 5/047

[52] U.S. Cl. ..... 430/58; 430/60; 430/65; 430/131

[58] Field of Search ..... 430/58, 60, 65, 13

[56] References Cited

U.S. PATENT DOCUMENTS 5,041,350 8/1991 Yagi ..... 430/60 X
5,166,020 11/1992 Fukuda et al. ..... 430/58

FOREIGN PATENT DOCUMENTS 158 1/1984 Japan ..... 430/60
96178 4/1990 Japan ..... 430/58

*Primary Examiner*—Roland Martin
*Attorney, Agent, or Firm*—Finnegan, Henderson, Farabow, Garrett & Dunner

[57] ABSTRACT

An electrophotographic photoreceptor is disclosed, comprising at least a substrate having thereon a charge transporting layer and a charge generating layer, wherein the charge transporting layer is a porous anodized aluminum film which is formed by anodizing a substrate at least a surface of which comprises aluminum or an aluminum alloy, with a conductive substance formed from an oxyacid salt of a transition metal being deposited to the inner wall of the pores thereof. The photoreceptor is excellent in physical properties, electrophotographic characteristics, and adhesion between the charge transporting layer and charge generating layer.

3 Claims, 1 Drawing Sheet

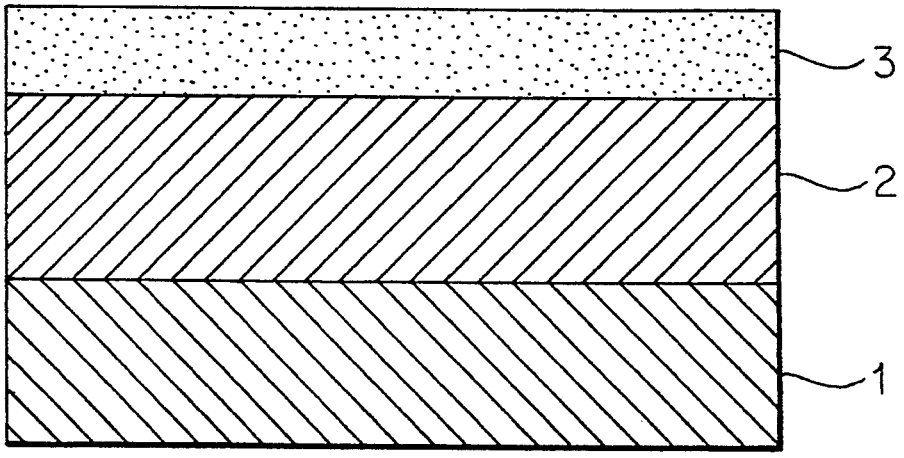
3
2
1

ELECTROPHOTOGRAPHIC PHOTORECEPTOR AND PROCESS FOR PRODUCING THE SAME

This application is a continuation of application Ser. No. 07/943,111, filed Sep. 10, 1992, abandoned, which is a continuation of application Ser. No. 07/586,285, filed Sep. 21, 1990, abandoned.

FIELD OF THE INVENTION

This invention relates to an electrophotographic photoreceptor and a process for producing the same. More particularly, it relates to an electrophotographic photoreceptor having a photosensitive layer of separate function type and to a process for producing the same.

BACKGROUND OF THE INVENTION

A so-called separate function type electrophotographic photoreceptor has a photosensitive layer composed of a charge generating layer capable of generating a charge carrier on light irradiation and a charge transporting layer into which the thus generated charge carrier can be efficiently introduced and which is capable of efficiently moving the thus generated charge carrier. In recent years, an amorphous silicon type electrophotographic photoreceptor having a charge generating layer made of amorphous silicon and a charge transporting layer made of an amorphous material which is formed by a plasma CVD method has been attracting attention because it has a possibility of basically improving charging properties and productivity of conventional amorphous silicon type photoreceptors without impairing excellent characteristics possessed by amorphous silicon, such as photosensitivity, high hardness, and heat stability and is therefore promising for obtaining electrical stability on repeated use and a long working life. Attention being paid on these aspects, amorphous silicon type electrophotographic photoreceptors using various charge transporting layers have been proposed. For example, a charge transporting layer which can be used in such an amorphous silicon type electrophotographic photoreceptor of separate function type includes a layer comprising silicon oxide or amorphous carbon formed by a plasma CVD method as disclosed, e.g., in U.S. Pat. No. 4,634,648.

In the above-described amorphous silicon type electrophotographic photoreceptor of separate function type, improvement in chargeability and reduction in dark decay can be brought about by using amorphous silicon as a charge generating layer and using, as a charge transporting layer, a substance having a smaller dielectric constant and higher resistance than the amorphous silicon. However, since a film formed by the above-mentioned plasma CVD method has the same rate of film formation as an amorphous type film and also has a complicated layer structure, the probability of film defects increases to reduce productivity of a photoreceptor, resulting in an extreme increase of production cost.

SUMMARY OF THE INVENTION

Accordingly, an object of the present invention is to provide an electrophotographic photoreceptor having an improved charge transporting layer.

That is, one object of the present invention is to provide a highly durable electrophotographic photoreceptor having a charge transporting layer which has satisfactory adhesion and high mechanical strength or hardness and is free from defects.

Another object of the present invention is to provide an electrophotographic photoreceptor which has high sensitivity, excellent panchromaticity, high chargeability, reduced dark decay, and reduced residual potential after exposure to light.

A further object of the present invention is to provide an electrophotographic photoreceptor whose charging characteristics are not affected by environmental changes.

A still further object of the present invention is to provide an electrophotographic photoreceptor which provides an image of high quality even on repeated use.

A yet further object of the present invention is to provide a process for producing the above-described electrophotographic photoreceptor.

The present inventors previously discovered that an oxide of aluminum has a function as a charge transporting layer, as disclosed in JP-A-63-63051 and JP-A-1-243066 (the term "JP-A" as used herein means an "unexamined published Japanese patent application). As a result of further investigations, it has now been found that a charge transporting layer comprising a porous aluminum oxide film formed by a specific process with a conductive substance deposited to the inner wall of the pores thereof shows further improvements in physical characteristics, electrophotographic characteristics, and adhesion to a charge generating layer. The present invention has been completed based on this finding.

The present invention relates to an electrophotographic photoreceptor comprising at least a substrate having thereon a charge transporting layer and a charge generating layer, in wherein the charge transporting layer is a porous anodized aluminum film which is formed by anodizing a substrate at least a surface of which comprises aluminum or an aluminum alloy, with a conductive substance formed from an oxyacid salt of a transition metal being deposited on the inner wall of the pores thereof.

The electrophotographic photoreceptor of the present invention can be produced by a process comprising subjecting a substrate at least a surface of which comprises aluminum or an aluminum alloy to anodic oxidation in a 1 to 30% by weight acidic aqueous solution containing an inorganic polybasic acid selected from sulfuric acid, phosphoric acid, chromic acid, etc. or an organic polybasic acid selected from oxalic acid, malonic acid, tartaric acid, etc. by using a direct current at a current density of from 0.1 to 10 $A.dm^{-2}$ to form a porous anodized aluminum film on the substrate, immersing the substrate having the porous anodized aluminum film in an aqueous solution of an oxyacid salt of a transition metal to deposit the oxyacid salt on the inner wall of the pores of the porous anodized aluminum film to form a charge transporting layer, and then forming a charge generating layer on the charge transporting layer.

If desired, the oxyacid salt of the transition metal deposited on the inner wall of the pores may be reduced.

BRIEF DESCRIPTION OF THE DRAWING

FIGURE of the drawing illustrates a schematic cross section of an embodiment of the electrophotographic photoreceptor according to the present invention.

DETAILED DESCRIPTION OF THE INVENTION

The FIGURE is a schematic cross section of the electrophotographic photoreceptor according to the present invention which comprises substrate 1, e.g., a pipe having a diameter of from 30 to 200 mm, porous anodized aluminum film 2 formed on substrate 1, and charge generating layer 3 formed on porous anodized aluminum film 2. In porous anodized aluminum film 2, a conductive substance is deposited on the entire inner wall of the pores thereof.

The substrate which can be used in the present invention includes an aluminum or aluminum alloy substrate (hereinafter inclusively referred to as an aluminum substrate), other conductive substrates, and insulating substrates. In using a substrate other than an aluminum substrate, it is necessary to form an aluminum film having a thickness of at least 5 μm, particularly at least 20 μm on the substrate at least over an area contacting with other layer. The aluminum film can be formed by vacuum evaporation, sputtering, or ion plating. Conductive substrates other than an aluminum substrate include metals, e.g., stainless steel, nickel, chromium, etc., and alloys thereof. Insulating substrates include films or sheets of high polymers, e.g., polyester, polyethylene, polycarbonate, polystyrene, polyamide, polyimide, etc., glass, and ceramics.

An aluminum material for obtaining an anodized aluminum film having satisfactory characteristics is properly chosen from among pure aluminum and aluminum alloy materials, such as Al—Mg, Al—Mg—Si, Al—Mg—Mn, Al—Mn, Al—Cu—Mg, Al—Cu—Ni, Al—Cu, Al—Si, Al—Cu—Zn, Al—Cu—Si, Al—Cu—Mg—Zn, and Al—Mg—Zn. Among these aluminum materials, Al—Mg and Al—Mn are preferred.

The porous anodized aluminum film formed on the aluminum surface of the substrate plays a roll as a charge transporting layer.

The porous anodized aluminum film is formed on the substrate by anodic oxidation as follows. A substrate with an aluminum surface having been polished to have a mirror finish and cut to a desired size is subjected to degreasing to completely remove oily contaminants attached during mechanical processing. Degreasing can be effected with a commercially available degreasing agent for aluminum (e.g., FC 315, a trade name, made by Nihon Parkerizing Co., Ltd.).

Subsequently, the porous anodized aluminum film is formed on the substrate.

An electrolytic solution (anodic oxidation solution) is filled in an electrolytic cell (anodic oxidation cell) made of stainless steel, hard glass, etc. to a prescribed level. The electrolytic solution which can be used is a 1 to 30% by weight (preferably a 5 to 25% by weight) acidic aqueous solution of an inorganic polybasic acid selected from sulfuric acid, phosphoric acid, chromic acid, etc. or an organic polybasic acid selected from oxalic acid, malonic acid, tartaric acid, etc. Among these inorganic or organic polybasic acids, sulfuric acid, phosphoric acid and oxalic acid are preferred. Pure water to be used as a solvent includes distilled water and ion-exchanged water. In order to prevent corrosion of the anodized aluminum film or production of pinholes, it is particularly required to remove impurities, e.g., chlorine, from water.

Then, the substrate having an aluminum surface and a stainless steel plate or an aluminum plate are immersed in the electrolytic solution as an anode and a cathode, respectively, with a given electrode gap therebetween. The electrode gap is appropriately selected from 0.1 to 100 cm. A direct current power source is prepared, and its positive (plus) terminal is connected to the aluminum surface of the substrate, with the negative (minus) terminal to the cathode plate, and electricity is passed through the both electrodes in the electrolytic solution. Electrolysis is carried out in a usual manner either by a constant current method or a constant voltage method. The direct current applied may consist solely of a direct current component or may comprise a combination of a direct current and an alternating current. A current density in carrying out anodic oxidation is set between 0.1 $A.dm^{-2}$ and 10 $A.dm^{-2}$ and preferably between 1 $A.dm^{-2}$ and 6 $A.dm^{-2}$. An anodizing voltage usually ranges from 1 to 150 V, and preferably from 5 to 100 V. The electrolytic solution has a temperature of from −5° to 100° C., and preferably from 10° to 80° C.

By electrolysis under these conditions, there is formed a porous anodized aluminum film on the aluminum surface of the substrate as an anode.

The porous anodized aluminum film serving as a charge transporting layer of the present invention preferably has a mean pore size of from 2 to 90 nm and a porosity of from 10 to 70%. Further the mean pore size is preferably from 5 to 60 nm, particularly preferably from 10 to 50 nm, and the porosity is preferably from 20 to 70%, particularly preferably from 30 to 70%. The terminology "porosity" as used herein means a ratio of the total area of pores to the whole area of the porous anodized aluminum film per unit area.

The thickness of the porous anodized aluminum film ranges from 1 to 100 μm, and preferably of from 5 to 50 μm. If desired, the thus formed anodized aluminum film is washed with pure water and dried.

Subsequently, an oxyacid salt of a transition metal is deposited on the inner wall of the pores of the porous anodized aluminum film. If desired, the deposited substance may be reduced. The deposited conductive substance contributes to charge transportation to improve charge transporting ability of the charge transporting layer.

Deposition of a conductive substance on the inner wall of the pores can be performed by immersing the substrate with a porous anodized aluminum film thereon in an aqueous solution containing an oxyacid salt of a transition metal or, if desired, followed by reduction of the deposited metal salt.

The oxyacid salt of a transition metal to be used preferably includes an oxyacid salt of at least one transition metal selected from W, Mo, Cr, and Mn. Examples of suitable oxyacid salts are hydrogen salts, ammonium salts, and alkali metal salts.

The immersion is usually carried out at a liquid temperature of from 10° to 70° C. In particular, a temperature ranging from 20° to 40° C. is preferred in view of high rate of adsorption and low rate of hydration of the film.

The porous anodized aluminum film with the oxyacid salt of a transition metal deposited is sufficiently washed with water to such an extent that the liquid used for the above-mentioned immersion treatment may not be carried over into the next step and then washed with ion-exchanged water or pure water.

If desired, the substrate is then subjected to a post-treatment in which it is dipped in an aqueous solution containing a reducing agent. Reducing agents which can be used in this post-treatment are not particularly limited as long as they are soluble in water to form an aqueous solution. Examples of suitable solutions of a reducing agent include an aqueous solution of a stannous compound and an aqueous solution of L-ascorbic acid. Although the post-treatment may not be carried out where the substrate undergoes reduction in the subsequent step, for example, in a plasma CVD step, it is preferably performed since such a reduction treatment causes the deposited metal to develop a color (for example, Mo or W develops a blue color) thereby making it possible to confirm the state of the deposit formed by the above-mentioned immersion treatment.

On the thus treated porous anodized aluminum film, a charge generating layer is directly formed with intimate contact. A charge generating layer includes a layer of an inorganic substance, e.g., amorphous silicon, selenium, selenium hydride, and selenium-tellurium, formed by plasma CVD, vacuum evaporation, sputtering or the like technique. Additionally included in a charge generating layer is a layer formed by vacuum evaporation of a dyestuff, e.g., phthalocyanine, copper phthalocyanine, Al-phthalocyanine, squaric acid derivatives, and bisazo dyes, or by dip coating of a dispersion of such a dyestuff in a binder resin. Inter alia, a charge generating layer formed of amorphous silicon or germanium-doped amorphous silicon exhibits excellent mechanical and electrical characteristics.

A case where a charge generating layer is formed by using amorphous silicon is instanced in illustration.

A charge generating layer mainly comprising amorphous silicon can be formed by a process appropriately selected according to the purpose from among known techniques, such as glow discharge decomposition, sputtering, ion plating, and vacuum evaporation. Glow discharge decomposition of silane or a silane type gas by plasma CVD is preferred. According to the process, a film containing an adequate amount of hydrogen which has relatively high dark resistance and high photosensitivity and thus exhibits favorable characteristics as a charge generating layer can be formed.

A plasma CVD method will be illustrated below.

Raw materials for forming an amorphous silicon photosensitive layer mainly comprising silicon include silanes, e.g., monosilane and disilane. If desired, a carrier gas, e.g., hydrogen, helium, argon, and neon, may be used in the formation of a charge generating layer. These starting gases may be doped with diborane ($B_2H_6$), phosphine ($PH_3$), etc. to form a layer containing an impurity element, e.g., boron, phosphorus, etc. For the purpose of increasing photosensitivity, etc., the photosensitive layer may further contain a halogen atom, a carbon atom, an oxygen atom, a nitrogen atom, etc. For the purpose of increasing sensitivity to a longer wavelength region, the layer may furthermore contain germanium, tin, etc.

The charge generating layer which can be preferably used in the present invention mainly comprises silicon and contains from 1 to 40 atom %, and particularly from 5 to 20 atom %, of hydrogen. The thickness of the charge generating layer is in the range of from 0.1 to 30 μm, and preferably of from 0.2 to 5 μm.

Conditions of forming a charge generating layer are usually from 0 to 5 GHz, preferably from 3 to 5 GHz, in frequency; usually from $1\times10^{-5}$ to 5 Torr (0.001 to 665 Pa), preferably from $1\times10^{-1}$ to 3 Torr in degree of vacuum on discharging; and usually from 100° to 400° C., preferably from 150° to 300° C. in substrate heating temperature.

If desired, the electrophotographic photoreceptor of the present invention may have a surface protective layer for preventing denaturation due to corona ion.

The present invention is now illustrated in greater detail with reference to Examples, but it should be understood that the present invention is not deemed to be limited thereto. All the percents are by weight unless otherwise specified.

EXAMPLE 1

An aluminum pipe (diameter: about 120 mm) made of an aluminum alloy containing 4% Mg was washed with a flon solvent and then subjected to ultrasonic cleaning in distilled water.

Subsequently, the aluminum pipe was subjected to anodic oxidation in pure water having dissolved therein 11% by volume of sulfuric acid kept at 20° C. by applying a direct voltage of 13 V at a current density of 2.0 $A.dm^{-2}$ between the aluminum pipe and a cathode of a stainless steel plate for 60 minutes to form a 20 μm thick porous anodized aluminum film.

After thoroughly washed with distilled water, the aluminum pipe was immersed in an aqueous solution containing 5 g/l of $(NH_4)_6Mo_7O_{24}.4H_2O$ at 25° C. for 10 minutes whereby a molybdic acid (VI) ion was adsorbed onto the inner wall of the pores of the porous anodized aluminum film.

After washing with water, the aluminum pipe was immersed in an aqueous solution containing 10 g/l of $SnSO_4$, 20 g/l of $H_2SO_4$, 5 g/l of $H_3PO_4$, and 10 g/l of $CH_3C_6H_3$-$(OH)SO_3H$ (o-cresol-4-sulfonic acid) at 25° C. for 5 minutes to reduce the molybdic acid (VI) ion to a molybdic acid (V) ion, whereupon the metal deposit developed a color, and the adsorption of the metal could be thus confirmed. The pipe was then washed with water and spontaneously dried.

The aluminum pipe having the thus treated porous anodized aluminum film was washed with distilled water, dried, and placed in a vacuum chamber of a capacity-coupled type plasma CVD apparatus. The aluminum pipe being maintained at 200° C., 100% silane gas ($SiH_4$), hydrogen-diluted 100 ppm diborane gas ($B_2H_6$), and 100% hydrogen gas ($H_2$) were introduced therein at a rate of 250 cc/min, 3 cc/min, and 250 cc/min, respectively. After the inner pressure of the vacuum chamber was set at 1.5 Torr (200.0 $N/m^2$), a high-frequency electric power of 13.56 MHz was applied to cause glow discharge, and the output of the high-frequency power source was maintained at 350 W. There was thus formed a 2 μm thick charge generating layer comprising so-called i-type amorphous silicon, containing hydrogen and a trace amount of boron, and having high dark resistance to obtain an electrophotographic photoreceptor.

Positive chargeability of the resulting photoreceptor was measured. When an electric current of 10 μA/cm was passed through the photoreceptor, the initial surface potential immediately after charging was 510 V, and the dark decay rate was 13%/sec. The residual potential after exposure to white light was 50 V, and the half-decay exposure amount (exposure required for the half decay of the surface potential) was 10 $erg.cm^{-2}$.

Adhesion between the charge generating layer and the porous anodized aluminum film was proved satisfactory.

COMPARATIVE EXAMPLE 1

An electrophotographic photoreceptor was prepared in the same manner as in Example 1, except that the charge generating layer was directly formed on the porous anodized aluminum film without depositing any conductive substance in the pores of the porous anodized aluminum film.

The resulting electrophotographic photoreceptor was evaluated in the same manner as in Example 1. The results obtained are shown below.

Initial Surface Potential: 550 V
Dark Decay Rate: 11%/sec
Residual Potential: 200 V
Half Decay Exposure Amount: 11 erg.cm$^{-2}$

EXAMPLE 2

The same aluminum pipe as used in Example 1 was subjected to anodic oxidation to form a porous anodized aluminum film in the same manner as in Example 1.

After washing with water, the aluminum pipe was immersed in an aqueous solution containing 10 g/l of $SnSO_4$ and 5 g/l of $H_3PO_4$ at 40° C. for 2 minutes to deposit a tin ion on the inner wall of the pores. Subsequently, the pipe was immersed in an aqueous solution containing 10 g/l of $(NH_4)_2O.12WO_3.5H_2O$ at 25° C. for 10 minutes to exchange the adsorbed tin ion with a tungstic acid (VI) ion in a reduced state.

A charge generating layer was then formed thereon in the same manner as in Example 1 to obtain an electrophotographic photoreceptor. The resulting electrophotographic photoreceptor was evaluated in the same manner as in Example 1. The results obtained are shown below.

Initial Surface Potential: 520 V
Dark Decay Rate: 12%/sec
Residual Potential: 40 V
Half Decay Exposure Amount: 10 erg.cm$^{-2}$

EXAMPLE 3

The same aluminum pipe as used in Example 1 was subjected to anodic oxidation to form a porous anodized aluminum film in the same manner as in Example 1.

After washing with water, the aluminum pipe was immersed in an aqueous solution containing 20 g/l of $(NH_4)_2CrO_4$ at 35° C. for 10 minutes to deposit a chromic acid (VI) ion on the inner wall of the pores. Subsequently, the pipe was immersed in an aqueous solution containing 10 g/l of $SnSO_4$, 20 g/l of $H_2SO_4$, and 5 g/l of $H_3PO_4$ at 40° C. for 8 minutes to conduct reduction, followed by washing with water and drying.

A charge generating layer was then formed thereon in the same manner as in Example 1 to obtain an electrophotographic photoreceptor. The resulting electrophotographic photoreceptor was evaluated in the same manner as in Example 1 . The results obtained are shown below.

Initial Surface Potential: 530 V
Dark Decay Rate: 10%/sec
Residual Potential: 60 V
Half Decay Exposure Amount: 9 erg.cm$^{-2}$ As described above, in the electrophotographic photoreceptor according to the present invention, the charge transporting layer comprises an anodized aluminum film with a conductive substance formed from an oxyacid salt of a transition metal being deposited on the inner wall of the pores thereof, on which a charge generating layer is directly formed. The photoreceptor having such a structure has high sensitivity, excellent panchromaticity, high chargeability, reduced dark decay, and reduced residual potential after exposure to light. The charging characteristics of the photoreceptor are not affected by the environmental changes, and an image of satisfactory quality can be obtained even on repeated running. Further, the photoreceptor of the present invention has extremely high adhesion between the charge transporting layer and charge generating layer, high mechanical strength or hardness, and reduced defects. Hence, the electrophotographic photoreceptor of the present invention is excellent in durability.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising at least a substrate having thereon a charge transporting layer and a charge generating layer, wherein said charge transporting layer is a porous anodized aluminum film which is formed by anodizing a substrate at least a surface of which comprises aluminum or an aluminum alloy, with a reduced conductive substance formed from an oxyacid salt of a transition metal being deposited in a reduced state on the inner wall of the pores thereof, wherein said porous anodized aluminum film has a thickness of from 1 to 100 μm.

2. An electrophotographic photoreceptor as claimed in claim 1, wherein said porous anodized aluminum film has a thickness of from 5 to 50 μm.

3. A process for producing an electrophotographic photoreceptor which comprises subjecting a substrate at least a surface of which comprises aluminum or an aluminum alloy to anodic oxidation in a 1 to 30% by weight acidic aqueous solution containing an inorganic polybasic acid selected from sulfuric acid, phosphoric acid, and chromic acid or an organic polybasic acid selected from oxalic acid, malonic acid, and tartaric acid by using a direct current at a current density of from 0.1 to 10 A.dm$^{-2}$ to form a porous anodized aluminum film on the substrate, immersing the substrate with the porous anodized aluminum film in an aqueous solution of an oxyacid salt of a transition metal to deposit said oxyacid salt on the inner wall of the pores of said porous anodized aluminum film to form a charge transporting layer, and then forming a charge generating layer on the charge transporting layer, wherein the oxyacid salt of a transition metal deposited on the inner wall of the pores is reduced prior to the formation of the charge generating layer.

* * * * *